United States Patent [19]

Stuart, Sr.

[11] 4,113,183

[45] Sep. 12, 1978

[54] NOZZLE FOR ROTARY FILTER PIPE

[76] Inventor: Fred E. Stuart, Sr., 1157 Bel Aire Dr., Daytona Beach, Fla. 32020

[21] Appl. No.: 736,475

[22] Filed: Oct. 28, 1976

[51] Int. Cl.[2] ..... B05B 1/32

[52] U.S. Cl. ..... 239/533.13; 239/602

[58] Field of Search ..... 239/533.13, 533.14, 239/554, 602, DIG. 4, 251, 254, 256, 257

[56] References Cited

U.S. PATENT DOCUMENTS

| | | | |
|---|---|---|---|
| 384,306 | 6/1888 | Bourdil | 239/533.13 X |
| 1,447,015 | 2/1923 | Emmons | 239/554 |
| 2,021,710 | 11/1935 | Wilson | 239/256 X |
| 2,338,820 | 1/1944 | Peters | 239/533.14 X |
| 2,622,928 | 12/1952 | Misch | 239/251 X |
| 3,351,292 | 11/1967 | Stuart, Sr. | 239/533.13 |
| 3,364,880 | 1/1968 | Ver Hoeven | 239/533.13 X |

FOREIGN PATENT DOCUMENTS

| | | | |
|---|---|---|---|
| 1,205,405 | 11/1965 | Fed. Rep. of Germany | 239/533.13 |

*Primary Examiner*—Joseph F. Peters, Jr.
*Assistant Examiner*—Michael Mar
*Attorney, Agent, or Firm*—Albert L. Jeffers; Roger M. Rickert

[57] ABSTRACT

In sand type filters, a pipe is often diposed beneath the surface of the sand bed and is rotatable on a vertical axis, located in the middle of the length of the pipe, horizontally and has nozzles extending along the trailing side of the pipe on each side of the axis of rotation. When these nozzles are supplied with fluid under pressure they cause the pipe to rotate and the water from the nozzles will agitate the filter and wash the soil therefrom, which can then be removed from the filter. A nozzle for this purpose is illustrated in my U.S. Pat. No. 3,351,292 and the present invention represents an improvement thereon by providing additional passages for fluid from the nozzle which not only assist in impelling the pipe in its rotary action but also provide for increased agitation of the filter bed.

5 Claims, 5 Drawing Figures

NOZZLE FOR ROTARY FILTER PIPE

RELATED PATENT

Fred E. Stuart, Sr., Inventor; U.S. Pat. No. 3,351,292; title: NOZZLE DISCHARGE CAP; patented Nov. 7, 1967.

The present invention relates to a nozzle arrangement and is particularly concerned with a nozzle arrangement for mounting on a pipe which is disposed in a horizontal plane beneath the upper surface of the filter bed and which pipe is rotatable about a vertical axis, located in the middle of the length of the pipe, under the influence of fluid under pressure, such as water, which is supplied through the nozzles mounted in the pipe on the trailing sides thereof.

The nozzle arrangement of the present invention is similar in purpose and configuration to the nozzle illustrated in my prior U.S. Pat. No. 3,351,292 of Nov. 7, 1967, but differs therefrom in the provision of auxiliary passages for fluid which not only assist in rotating the pipe on which the nozzles are mounted but also improve the agitation of the filter bed which is being treated by the rotary pipe.

An object of the present invention is the provision of an improved nozzle for mounting on rotary back washing pipes for filters.

A still further object of the present invention is the provision of an arrangement for improving efficiency of the back washing of filters, such as, sand filters, or filters containing "anthrafilt" or other filter media.

BRIEF SUMMARY OF THE INVENTION

In my earlier patent above referred to, I show how nozzles of the nature referred to can be provided with a rubber-like cap which prevents the ingress of the filter media through the nozzle and into the pipe on which the nozzle is mounted. This is advisable because, when the nozzles are provided with a single lane passage therethrough, substantial amounts of filter material can get into the pipe through the nozzles passage.

I have discovered, however, that the action of the nozzle for driving the pipe on which it is mounted in rotation and for agitating the filter bed can be improved if a plurality of small holes, or at least one hole, is provided in the filter cap which provides for a supply of fluid directed angularly outwardly from the nozzle in the same general direction as the main jet of fluid from the nozzle. This added supply of fluid not only assists in driving the pipe in rotation but also provides for extremely good agitation of the filter bed.

According to the present invention, a filter bed which may be made up of sand or other material supported on a frame, or support member, is provided with a horizontal pipe located beneath the upper level of the filter bed which is rotatable about a vertical axis extending through the center of the pipe. The pipe has nozzles projecting rearwardly therefrom, or on the trailing side of the pipe, on both sides of the axis of rotation so that when water under pressure is supplied to the pipe, the jets of fluid issuing from the nozzles will cause the pipe to rotate within the filter bed, while at the same time the jets agitate the filter bed and dislodge solid filtered-out material therefrom. The thus released material floats off through an overflow so that after a predetermined length of time the filter bed is cleaned of soil and can be returned to service.

When the filter is in service, the water supplied through the pipe and jets to the filter bed is interrupted and the water to be filtered is brought in on top of the filter bed and filters downwardly therethrough to a discharge conduit.

The present invention is particularly concerned with improvements in the nozzle arrangement mounted on such a pipe. In my prior U.S. Pat. No. 3,351,292 I show how a nozzle body can be threaded into the side of the pipe and provided with a rubber-like cap which will permit water to flow outwardly through the nozzle from the pipe but which will substantially prevent any sand, or whatever filter media that is being employed, from flowing into the pipe from the filter bed.

My prior invention has proved to be highly satisfactory but I found in a number of cases that a filter bed can be backwashed more efficiently with a greater supply of water and that there are cases when an added jet action is of benefit in starting the pipe supporting the nozzles to rotating.

The present invention proposes to provide extra passage means in the nozzle body extending outwardly in the nozzle body rearwardly of the rubber-like cap thereon and inclined in the circumferential direction so that when water is supplied to the central passage in the nozzle, it will also flow through the added passage means and not only provide for a stronger driving force to cause the pipe to rotate but will also substantially increase the agitation of the filter bed, thereby creating more favorable backwashing conditions. The net result is that the filter bed can be backwashed more quickly and more efficiently by the practice of the present invention than heretofore.

The added passage means can be relatively small, thereby inhibiting the entrance of any filter media into the nozzle where the particle size is large enough and minimizing the amount of fines that can enter the passage in the filter.

In one modification, I show how the added passage means can be provided with a valve which prevents fluid as well as any filter media from flowing inwardly into the nozzle passage when the pipe is not rotating and the filter is in operation, filtering water.

The exact nature of the present invention will become more clearly apparent upon reference to the following detailed specification taken in connection with the accompanying drawings, in which.

DETAILED DESCRIPTION OF THE INVENTION

Figure 1:
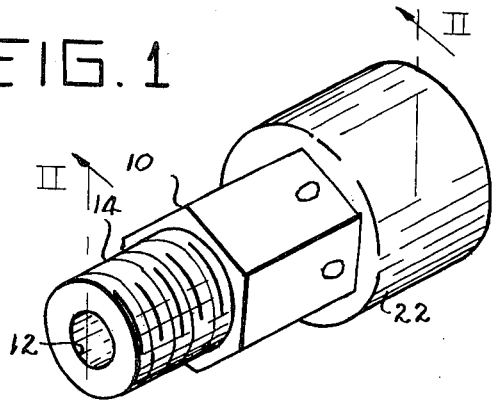
FIG. 1 is a perspective view, showing a nozzle construction according to the present invention.
Figure 3:
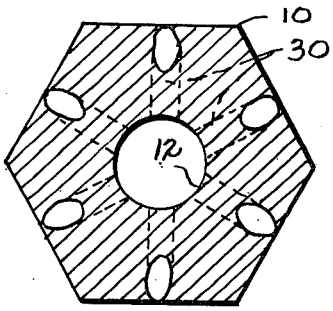
FIG. 3 is a transverse sectional view indicated by lines III—III on FIG. 2, showing how the added passages according to the present invention are distributed circumferentially in the nozzle body.
Figure 2:
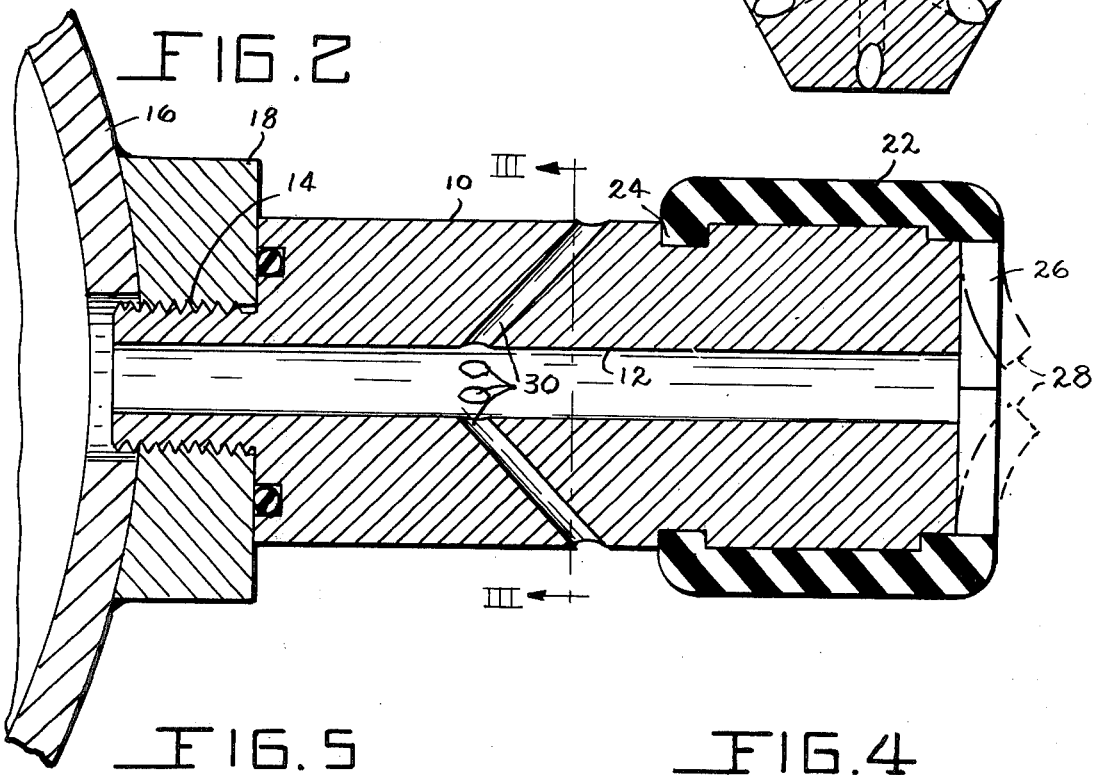
FIG. 2 is a vertical longitudinal sectional view indicated by lines II—II of FIG. 1, showing the nozzle in longitudinal section.

Referring to the drawings somewhat more in detail, the nozzle device according to the present invention will be seen in FIGS. 1, 2 and 3, to comprise a nozzle body 10 having a central passage 12 extending axially therethrough. At one end the body 10 has a reduced diameter threaded portion 14, threaded into a pipe member 16 which advantageously has a boss member 18 welded thereon and drilled and threaded for receiving the threaded portion 14 of the nozzle body.

The nozzle body has an annular recess 20 formed therein and has a rubber-like cap 22 mounted on the outer end which has a flange 24 seated in groove 20 to retain the cap on the nozzle.

The outer end of the cap 22 has incisions therein forming flaps 26 which yield outwardly when passage 12 is subjected to pressure. The yielded flaps are shown at 28. When the passage 12 is not under pressure, the flaps fold inwardly and prevent filter material from entering passage 12.

According to the present invention, additional passages are drilled from central passage 12 outwardly to the outer surface of the nozzle body rearwardly of the back edge of cap 22. The nozzle body 10 is advantageously formed of hexagonal stock, or is at least hexagonal rearwardly of cap 22, and it is, therefore, convenient to provide six additional channels as indicated at 30. These channels are inclined outwardly toward the outer end of nozzle body 16 as shown in FIG. 2, and project a rather large cone of fluid outwardly and toward the rearward side of pipe 16 so that a strong rotary impulse is imparted to pipe 16 by the several nozzles distributed along the trailing sides thereof. Furthermore, the filter bed is thoroughly agitated in considerable depth and highly efficient and rapid cleaning thereof results.

The additional passages 30 may be relatively small in size and thereby inhibit the ingress of filter medium into passage 12 and efficient operation of the system will still be had. However, the passages will never be as large as central passage 12 and, thus, even under the worst conditions, will not permit more than a small amount of filter medium to enter the central passage 12 of the nozzle.

Figure 5:
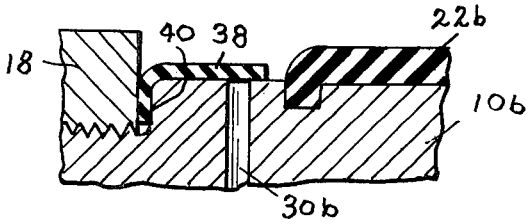
FIG. 5 is a view similar to FIG. 4, showing a still further modification of the present invention.
Figure 4:
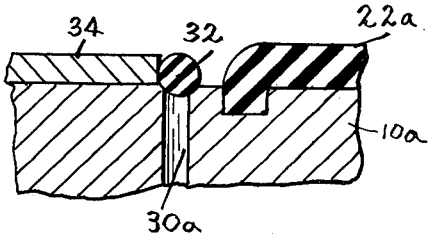
FIG. 4 is a fragmentary view, showing one modification according to the present invention.

However, if the filter bed contains an extremely fine medium, and it is desired to be certain that no filter medium will enter the nozzle body while, at the same time, presenting the advantage that the additional passages can be drilled radially, a modification according to either FIGS. 4 or 5 could be employed.

In FIG. 4, nozzle body **10*a* has radial passages 30*a* formed therein which lead into the central passage in the nozzle body. The passages 30*a* terminate at the outer ends in an annular groove 32 in which is seated a resilient "O" ring 34 which may be relatively soft. Advantageously, a sleeve 36 on the nozzle body rearwardly of the "O" ring 34 prevents the "O" ring from being dislodged from the nozzle body while, at the same time, causing fluid flowing radially outwardly through passages 30*a* to jet outwardly and toward the free end of the nozzle body in about the same direction as the fluid issues from a passage 30 of FIG. 2**.

FIG. 5 shows a similar arrangement in which nozzle body **10*b* is provided with radial passages 30*b* with the outer ends thereof normally closed by a yieldable rubber-like sleeve 38 which has a flange portion 40 at one end which forms the seal between body 10*b* and the boss 18 which is welded to pipe 16**.

In the FIG. 5 modification, when pressure is supplied to passage **30*b*, the righthand end of sleeve 38 will yield outwardly and fluid from the passages will jet outwardly and toward the free end of the nozzle body, thereby obtaining the same effect as obtained by the inclined passages 30 in the FIG. 2** modification.

Modifications may be made within the scope of the appended claims.

What is claimed is:

1. In a nozzle, especially for mounting on the trailing side of a rotary filter pipe through which water is supplied to the nozzle, the water exiting the nozzle providing thrust tending to cause rotation of the pipe; a nozzle body having an inner end adapted for connection to a pipe and also having an outer end from which the water exits, said body also having a central passage extending axially therethrough from inner to outer end, further passage means in said body comprising a plurality of uniformly radially distributed auxiliary passage means each of a smaller cross-sectional area than the cross-sectional area of the central passage outer end and inclined from said central passage outwardly to the surface of said body so that water may also exit the nozzle body by way of the further passage means in a direction to aid the thrust tending to cause rotation of the pipe, and valve means mounted on said body and normally closing said auxiliary passage means at the surface of said body to normally prevent flow of water through said auxiliary passage means and yieldable in response to the supply of water under pressure to said auxiliary passage means from said central passage to permit water to emerge from said auxiliary passage means to the exterior of the body, said valve means directing the water emerging from said auxiliary passage means angularly toward the outer end of said body.

2. A nozzle according to claim 1 in which said auxiliary passage means incline toward the outer end of said body in the radially outward direction.

3. A nozzle according to claim 1 which includes a shoulder on said body engaging the axial side of said ring which faces said inner end of said body.

4. A nozzle according to claim 1 in which said valve means comprises a sleeve fitted over said body from said inner end and having one end extending to beyond the plane where the auxiliary passage means emerge through the surface of the body, said one end of said sleeve being yieldable when said auxiliary passage means is supplied with water under pressure from said central passage to permit the water to emerge from the auxiliary passage means while directing the water angularly toward the outer end of the body.

5. A nozzle according to claim 1 which includes valve means in the form of a resilient cap member fitted over said body from the outer end thereof and preventing flow into the adjacent end of said central passage means while permitting flow of water therefrom.

* * * * *